US007451963B2

(12) United States Patent
Finkenbusch et al.

(10) Patent No.: US 7,451,963 B2
(45) Date of Patent: Nov. 18, 2008

(54) LEADING SHEAVE MINE WINDING ENGINE WITH IMPROVED COOLING AIR CONDUCTION

(75) Inventors: Rainer Finkenbusch, Waltrop (DE); Norbert Bauer, Dortmund (DE); Rolf Heep, Wilsdorf (DE); Frank Kristek, Herdecke (DE)

(73) Assignee: Deilmann-Haniel Mining Systems GmbH, Dortmund (DE)

( * ) Notice: Subject to any disclaimer, the term of this patent is extended or adjusted under 35 U.S.C. 154(b) by 0 days.

(21) Appl. No.: 11/660,983

(22) PCT Filed: Sep. 8, 2005

(86) PCT No.: PCT/DE2005/001571

§ 371 (c)(1),
(2), (4) Date: Feb. 23, 2007

(87) PCT Pub. No.: WO2006/029598

PCT Pub. Date: Mar. 23, 2006

(65) Prior Publication Data

US 2008/0006803 A1 Jan. 10, 2008

(30) Foreign Application Priority Data

Sep. 14, 2004 (DE) ..... 10 2004 044 911

(51) Int. Cl.
*B66D 1/26* (2006.01)

(52) U.S. Cl. ..... 254/278

(58) Field of Classification Search ..... 254/360, 254/362, 366, 371, 278
See application file for complete search history.

(56) References Cited

U.S. PATENT DOCUMENTS 4,355,785 A * 10/1982 Tosato et al. ..... 254/362
5,018,603 A * 5/1991 Ito ..... 187/254
5,098,068 A * 3/1992 Jussila ..... 254/342

FOREIGN PATENT DOCUMENTS

DE 4222094 C1 11/1993
DE 4405593 C1 7/1995

* cited by examiner

*Primary Examiner*—Emmanuel M Marcelo
(74) *Attorney, Agent, or Firm*—James Creighton Wray; Clifford D. Hyra

(57) ABSTRACT

The invention relates to a Koepe winder or drum winder comprising an electric motor (5) for driving winding ropes (11). The rotor (6) of said motor is connected to the cylinder jacket (4) of the Koepe winder (2) and the stator frame (7) is fixed on a support structure that has a hollow shaft (3). The winder is characterised by an improved ventilation system. The motor (5) is located inside the cylinder jacket (4) in a cavity (12) between the plates (13) of the Koepe winder (2), said cavity being supplied with cooling air to ventilate the motor (5) from the exterior The hollow shaft (3) is formed by two half-shafts (18, 19), which together with at least one support disc (8) and the stator frame (7) form the support structure (10).

17 Claims, 5 Drawing Sheets

LEADING SHEAVE MINE WINDING ENGINE WITH IMPROVED COOLING AIR CONDUCTION

This application claims the benefit of German Application No. 10 2004 044 911.2 filed Sep. 14, 2004 and PCT/DE2005/001571 filed Sep. 8, 2005, which are hereby incorporated by reference in their entirety.

BACKGROUND OF THE INVENTION

The invention relates to a Leading sheave winder or a drum winder comprising an electric motor for driving winding ropes. The rotor of said motor is connected to the cylinder jacket of the Leading sheave winder and the stator frame is secured on a support structure that has a hollow shaft, wherein the motor is located within the cylinder jacket and between the plates of the Leading sheave winder in a cavity, whereby said cavity can be supplied with cooling air to ventilate the motor from the exterior.

Such mine winding engines are known from DE-PS 42 22 094 or DE-PS 44 05 593, for example. The former has a hollow shaft with an enlarged diameter in the middle part and two opposed inclined horizontal wall sections through which the cooling air is to be directed in an essentially radial manner onto the inner side of the Leading sheave winder plates of the cylinder jacket. The latter has a massive one-part shaft, ventilation rings for conducting the cooling air being envisaged between the shaft and the anti-friction bearings connecting said shaft to the cylinder jacket. Both Leading sheave mine winding engines have the disadvantage that the cooling of the motor takes place in an ineffective way. Furthermore, and where the above-mentioned solutions are concerned, there are either relatively large bearing clearances caused by the connections of the cooling air ducts between the bearings or there are very voluminous shaft components that are difficult to handle at the same time.

Subsequently, the invention is based on the task of creating a Leading sheave winder or a drum winder with improved cooling air conduction and with more compact dimensions.

SUMMARY OF THE INVENTION

This task is solved in such a way that the hollow shaft is formed by at least two half shafts, which, together with at least one support disc and the stator frame, form the support structure.

In this way, a particularly direct conduction of the cooling air is ensured from the hollow shaft into the cavity surrounding the motor and past the motor to be cooled, and again back into the hollow shaft. At the same time, given the arrangement and formation of the support structure, a direct cooling of the stator frame is effected. In this case, the support disc can be part of the stator frame.

In particular the concept here takes into account that a ventilation zone is envisaged, which is supplied with cooling air by way of the hollow shaft and enclosed by the stator frame, as well as the lateral support discs connecting together the hollow shaft and the stator frame. Via the ventilation zone enclosed by the stator frame and the side discs, which zone can be understood both a separated as well as an open ventilation zone in transition into the cavity, the air flows into the cavity surrounding the motor and past the motor to be cooled and again back into the ventilation zone resp. the hollow shaft.

A particularly advantageous embodiment of the invention then envisages that the side discs are arranged at least approximately vertical to the hollow shaft. These side discs resp. side support discs are connected to the hollow shaft with their ends facing said hollow shaft.

The ventilation zone is allocated to the hollow shaft, i.e., the cooling air flows through the hollow shaft into the ventilation zone, from there into the cavity, again back into the ventilation zone and from there the heated cooling air is conducted back through the hollow shaft. In order to accomplish the air supply and discharge in the ventilation zone, a partition wall dividing the ventilation zone into a supply line and a discharge line is envisaged between the side discs. This is to be located purposefully parallel to the side discs and in the middle position in the ventilation zone.

In principle, a structural component can then be saved if the support disc is formed as a partition wall at the same time by it having a corresponding length.

This variant of the invention is realised in such a way that the half shafts are connected to the support disc at their inner ends by means of flanges. These flanges are again provided with boreholes, through which the air can enter the cavity surrounding the motor zone and can flow back again. The flanges are here connected with their front sides in each case to the support disc.

A further preferred embodiment of the invention envisages that radial-aligned cooling air ducts, through which an additional cooling effect can be achieved, are integrated into the connecting flanges of the half shafts.

The cooling air must flow from the ventilation zone into the cavity surrounding the motor, for which reason it is proposed that the side discs have openings to, as seen with reference to the hollow shaft, the axial cooling air outlet resp. inlet. In this way the cooling air flows directly through the openings into the cavity, a cooling of the inner side of the stator frame taking place at the same time because the air flow is routed past that location also. The openings should be positioned approximately in the middle of the side walls of the ventilation zone and serve simultaneously as mounting aid with regard to the connection between hollow shaft and stator frame.

One embodiment of the invention envisages here that the half shafts are, in each case, connected in a detachable manner with a side disc at their individual inner ends for the purpose of which, for example, a screwed joint is envisaged.

Additional stability in the ventilation zone, in particular for the purpose of absorbing a part of the load exerted onto the side discs, is achieved in such a way that reinforcing metal sheets are envisaged in the ventilation zone extending in the radial direction to the hollow shaft. Preferably eight or twelve reinforcing metal sheets surround the hollow shaft in a star-shaped configuration with equal spacing in the radial direction and extend purposefully up to the stator-side end of the support structure.

An advantageous double effect can be obtained if the reinforcing metal sheets are formed as air baffle plates. With the formation and arrangement of the air baffle plates, the air conducted through the hollow shaft into the corresponding ventilation zone half can be conducted in the direction of the openings to the cavity surrounding the motor and/or in the direction onto the inner side of the motor. In this way, there is an enlarged surface for the heat transition.

For the air supply and discharge to and from the cavity, it is envisaged that the hollow shaft is provided with boreholes for the supply air and/or the discharge air, which correspond with the ventilation zone. In this case, the hollow shaft has boreholes, through which the supply air flows into the ventilation zone and has on the other side of the partition wall further boreholes, through which the returning air again flows back from the ventilation zone into the hollow shaft. Both half shafts are joined together by means of flange connections.

Instead of envisaging boreholes in the hollow shaft itself it is also conceivable with a hollow shaft that, between both half shafts, a middle structural component, which is formed from the central shaft section and both side discs, is envisaged.

This middle structural component also comprises a shaft section with boreholes for the supply and discharge air. This is a separate central shaft section in this particular case. It is proposed accordingly that the boreholes are envisaged in the central shaft section.

With regard to the last-mentioned variants with boreholes in the half shaft resp. in the central shaft section, it is understood that supply air and discharge air must be partitioned off against one another. It is therefore conceived that the boreholes for the supply air and the boreholes for the discharge air are separated from one another by an additional partition wall or by an extension of the partition wall. This partition wall can be in two parts, an inner part of the partition wall being arranged here in the hollow shaft while another part of the partition wall is located in the ventilation zone. In this case, the inner and outer parts are separated from one another by the outer wall of the pipe of the hollow shaft resp. of the shaft section.

A further advantageous embodiment of the invention envisages that the bearing seats for connecting the hollow shaft with the cylinder jacket are allocated to the hollow shaft. This offers significantly more suitable connection options for the loose resp. fixed bearings, with which the hollow shaft is connected to the cylinder jacket of the Leading sheave winder. In this case, the bearing seats are integral parts of the half shafts and are manufactured with these in one-part design or as separate structural components.

A further aspect of the invention relates to the hollow shaft. Accordingly, this has a polygon-type cross-section, particularly a rectangular, hexagonal or octagonal cross-section. This is advantageous, on the one hand, because the hollow shaft does not have to be equipped with an additional anti-twist protection, which would otherwise have to be accomplished by changing the cross-section between the bearing ends from a round-shaped to a polygonal cross-section. This not only requires a particularly great effort but also involves unnecessary static problems. On the other hand, the advantage of a throughout polygon-type cross-section of the hollow shaft is that the connection means for the air supply and discharge are significantly better with a polygonal cross-section.

The invention distinguishes itself in particular by improved cooling air conduction in the Leading sheave winder or drum winder. The hollow shaft is formed in two parts, both shaft halves forming with at least one support disc and the stator frame the support structure. Here, one or several support discs can also be integrated in the stator frame. The air is conducted past this support disc. In one variant, an additionally formed ventilation zone is envisaged between the hollow shaft and the stator frame, which zone is limited laterally by two support discs formed as side discs. Here, the cooling air is conducted through a supply line into the ventilation zone, past the inner side of the stator frame through the openings into the side space and out into the zone surrounding the motor, and the return flow of the heated air is effected accordingly. In this case, above all, the direct contact of the cooling air with the inner side of the stator frame is advantageous because an additional and a more direct cooling effect already takes place here.

Further details and advantages of the invention result from the following description of the relevant drawings, in which a preferred executive example is presented and illustrated together with the details and individual components as required in this respect. The drawings show the following:

DETAILED DESCRIPTION OF THE PREFERRED EMBODIMENTS

Figure 1:
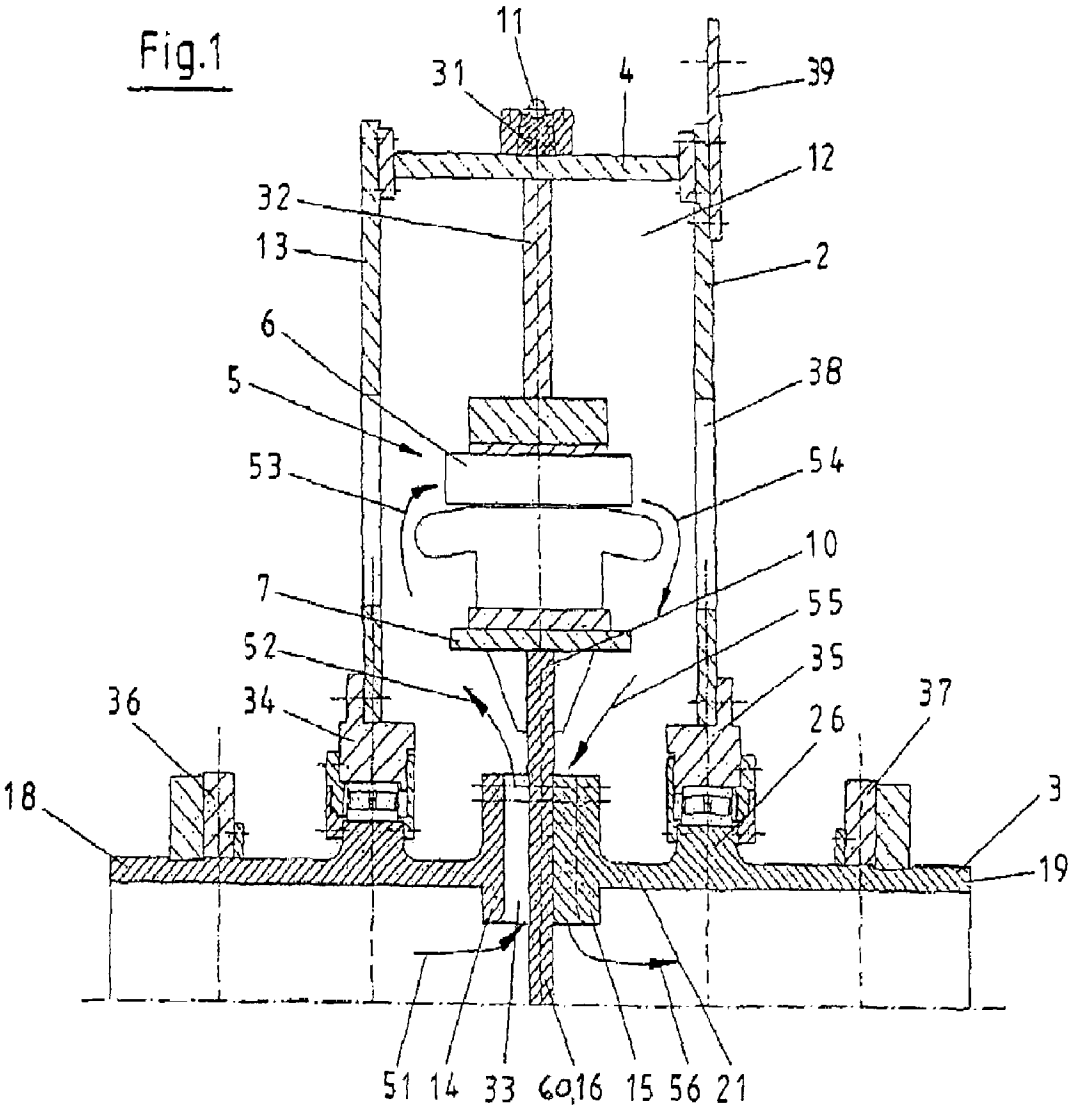
FIG. 1 the cross-section through an upper part of a Leading sheave mine winding machine with a support disc, FIG. 2 a machine according to FIG. 1 with two side discs, FIG. 3 a machine according to FIG. 1 with a middle structural component, FIG. 4 a variant to FIG. 3 and FIG. 5 a hollow shaft with polygon-type cross-section in perspective view.

FIG. 1 shows a Leading sheave mine winding machine with the Leading sheave winder 2, around which the winding rope 11 in the Leading sheave winder lining 31 is conducted. The cylinder jacket 4 is connected to the motor 5 via a ligament plate 32. This motor 5 is located in a cavity 12 that is encased by the cylinder jacket 4 and the side plates 13. This cavity 12 serves the purpose of ventilation of the motor 5 resp. of rotor 6 and stator frame 7 from the exterior with cooling air, which flows through the hollow shaft 3 into the cavity 12 and flows out again from the after. Both half shafts 18 and 19 are connected by means of the connecting flanges 14 and 15 to the support wall 60, which is one-part here. Support wall 60, hollow shaft 3 and stator frame 7 form the support structure 10 here. Boreholes 33, which are presented here only for the supply of cooling air in the direction of the cavity 12, remain. Here, the support wall 60 is formed as partition wall 16 as well. The arrow 51 symbolises the entry of the cooling air from the hollow shaft 3 into the borehole 33, the arrow 52 the entry into the cavity 12, the arrows 53 and 54 the circulation therein and the arrows 55 and 56 the outflow into the hollow shaft 3 through the boreholes not shown here. Also visible are the bearing seats 25, 26 for the loose bearing 34 resp. the fixed bearing 35 and the connection of the cylinder jacket 4. In this case these bearing seats 25, 26 are allocated to the hollow shaft 3 and manufactured with this as one part, so that a simplified assembly possibility is provided. The shaft bearings are designated with the reference numbers 36 and 37. An assembly window 38 can further be seen in the plate 13 of cylinder jacket 4. The brake discs at the outer end of the cylinder jacket 4 are given the reference number 39.

Figure 2:
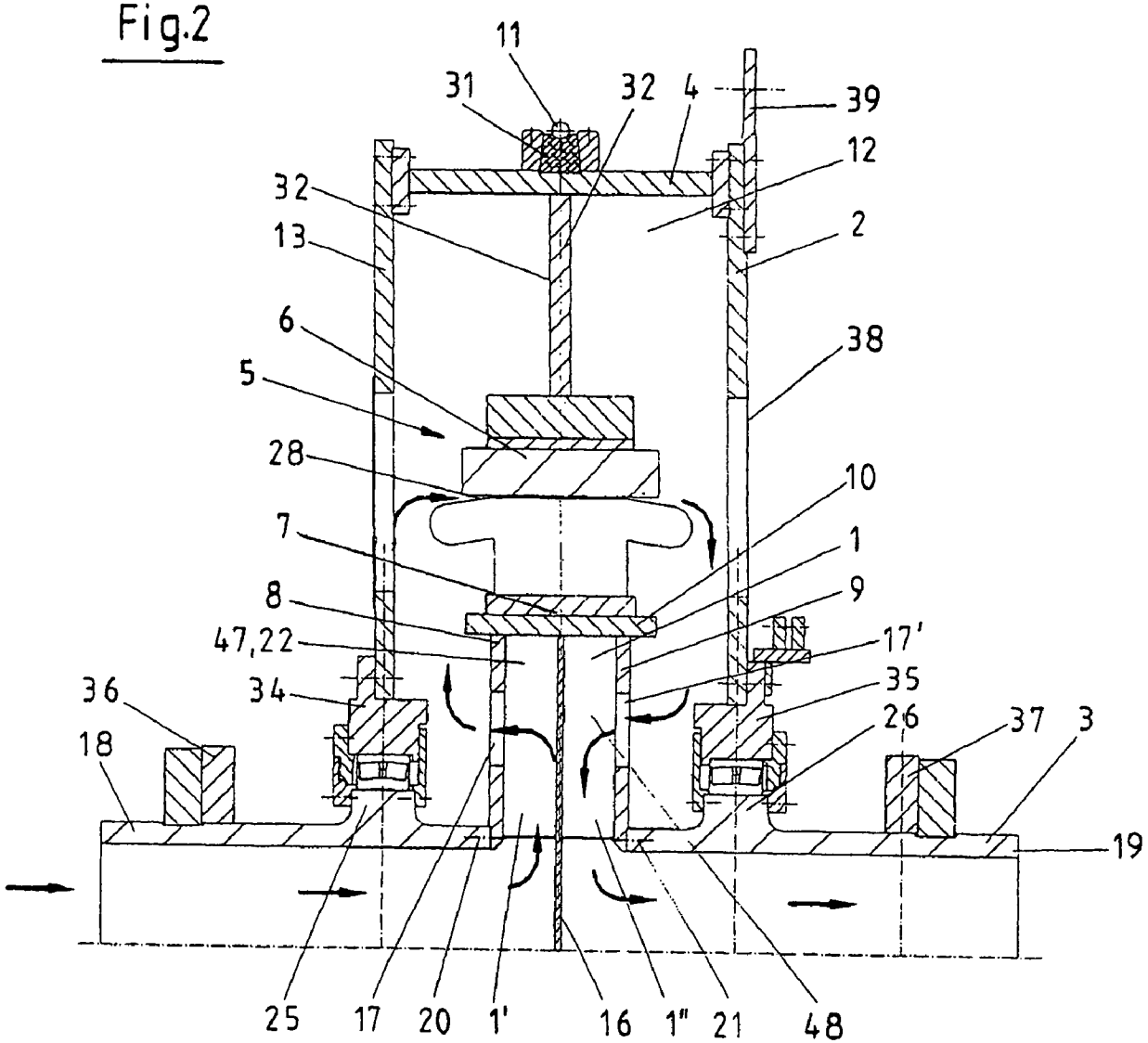

In FIG. 2, the arrow 40 symbolises the cooling air inflow through the ventilation zone 1 into the cavity 12 and out of this again, symbolised by the cooling air outflow 41. Between the hollow shaft 3 and the cavity 12 is arranged a ventilation zone 1, which, on the one hand, consists of a supply line 1' and a discharge line 1" separated from this by means of a one-part partition wall 16. The ventilation zone 1 is limited to the side by the support discs formed here as side discs 8, 9 which have openings 17, 17' through which the supply air can flow into the cavity 12 surrounding the motor zone 5 resp. can flow out of said cavity again. In an advantageous manner, with the arrangement according to the invention, a particularly effective ventilation can be accomplished by ensuring that the supply air not only flows out directly through the openings 17 in the side disc but, in addition, comes into contact with the stator frame 7 so that the latter is cooled as well. Here, the cooling air can distribute itself evenly and additionally in the cavity 12, given that it can also pass through the air gap 28 between rotor 6 and stator frame 7. Following this, it is conducted through the opening 17' in the side disc 9 into the discharge line 1" and, from there, back into the hollow shaft 3. The hollow shaft 3 is formed by two half shafts 18, 19 which are connected, at their ends 20, 21 facing towards each other, to the side discs 8, 9 in a fixed or detachable manner. Additional stability in the ventilation zone, in particular for the purpose of taking up a part of the load exerted on the side discs 8, 9, is provided by the reinforcing sheets 22 extending in the radial direction to the hollow shaft 3, which sheets surround the hollow shaft 3 in a star-shaped configuration. They function also as air baffle plates by conducting the cooling air towards the opening 17 to the cavity 12 surrounding the motor 5 and/or towards the stator frame 7.

Figure 3:
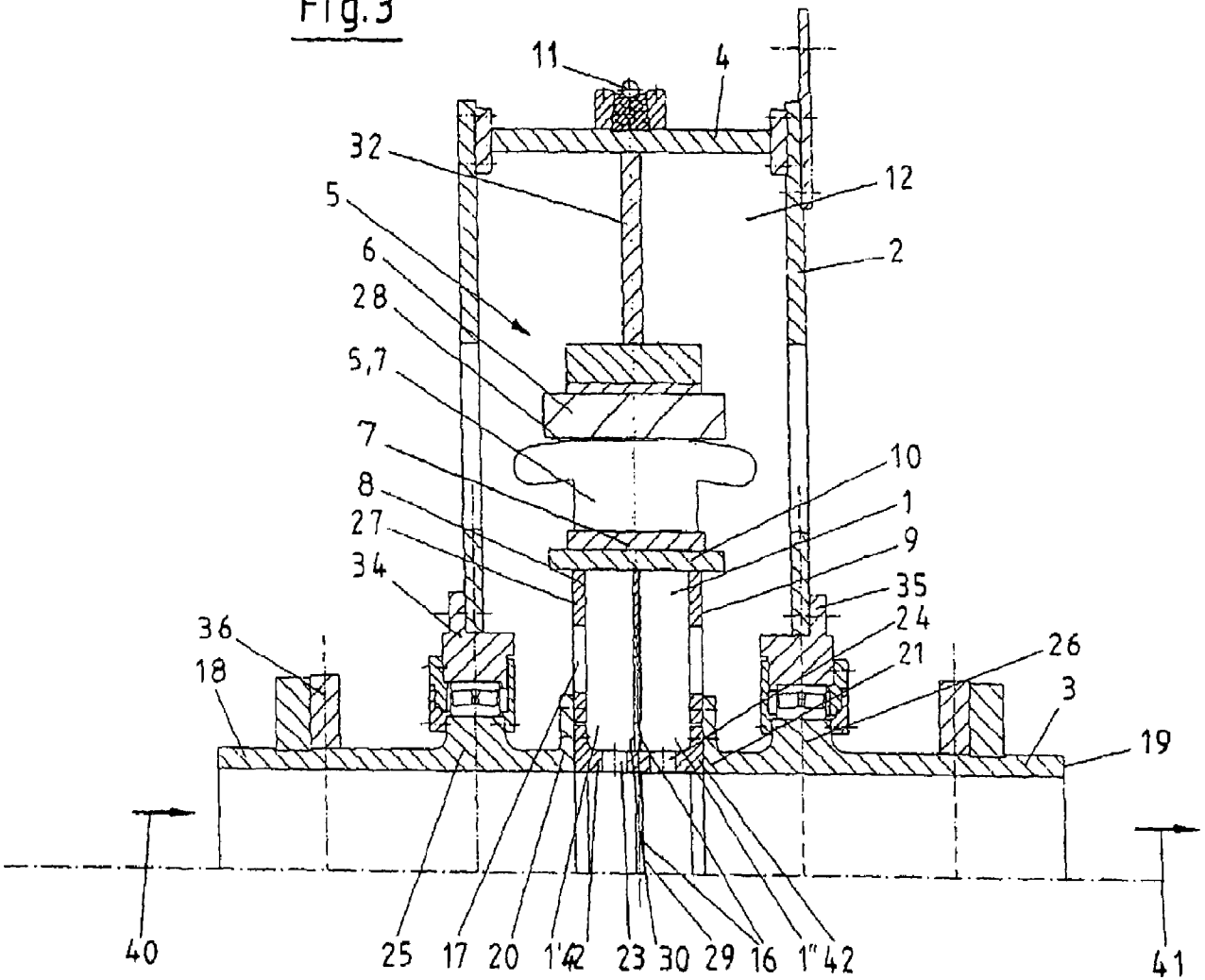

The representation in FIG. 3 differs in particular from that in FIG. 2 in that, between both half shafts 18 and 19, is positioned a middle section 27, which accommodates on the one hand the side discs 8 and 9 and, on the other hand, the central shaft section 42. This section comprises the boreholes 23, 24, where the former is envisaged for the air supply into the ventilation zone 1' and the latter is envisaged for the return flow of the air out of the ventilation zone 1" again. The middle structural component 27 has a fixed or detachable connection to the half shafts 18, 19 and has here both parts 29 and 30 of the partition wall 16. Here, the outer part 29 of the partition wall 16 within the ventilation zone 1 is envisaged for partitioning. The inner part 29 is for the partitioning of hollow shaft 3.

Figure 4:
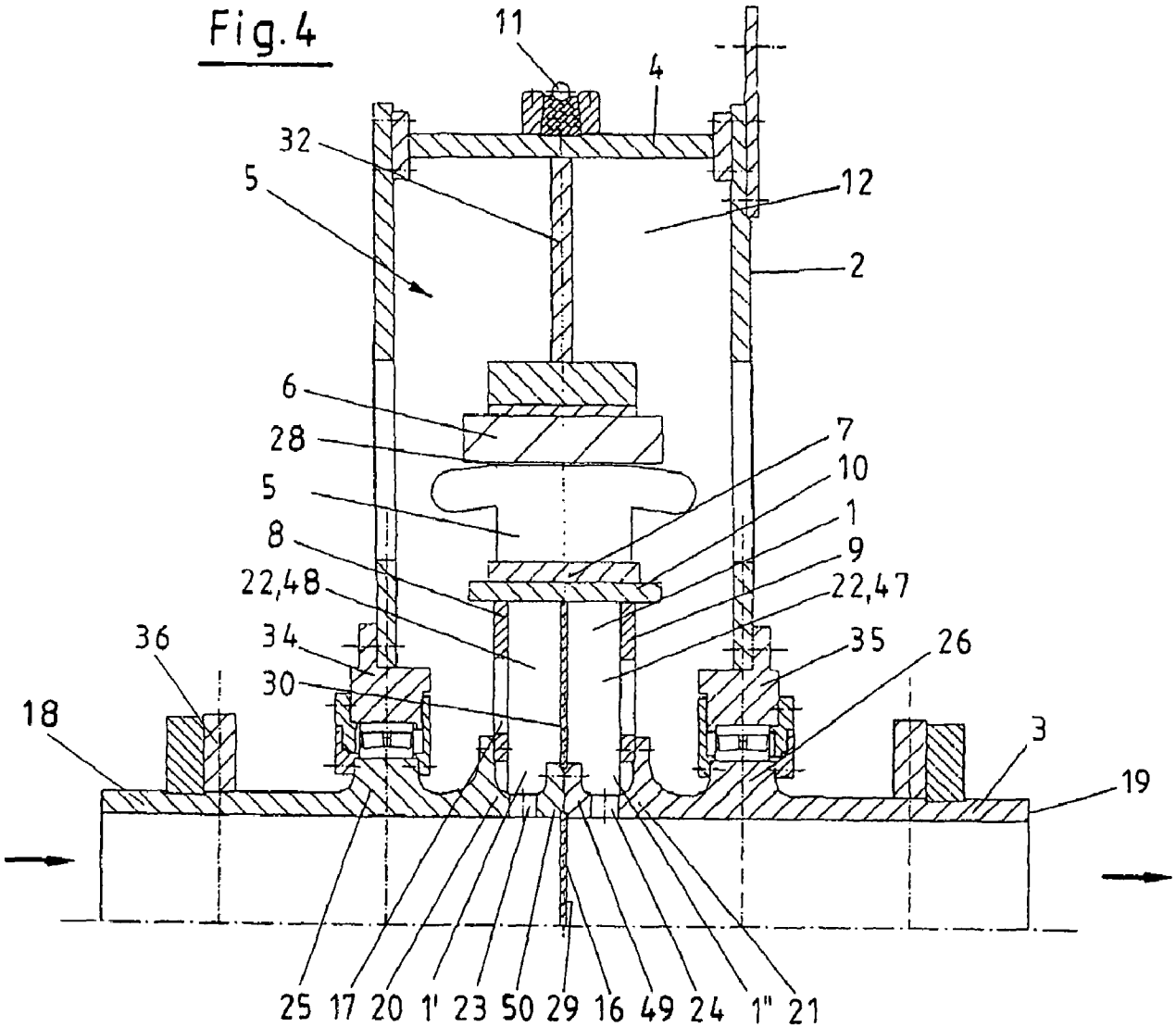

An alternative embodiment is shown in this respect in FIG. 4. This involves a hollow shaft 3 that is provided with boreholes 23, 24, which are in turn arranged correspondingly to the ventilation zone 1 resp. 1' and 1" with regard to air supply and discharge. Both half shafts 18, 19 here are directly connected together by means of the flanges 49, 50. And here also, the partition wall 16 is divided up into an outer part 30 and an inner part 29.

Figure 5:
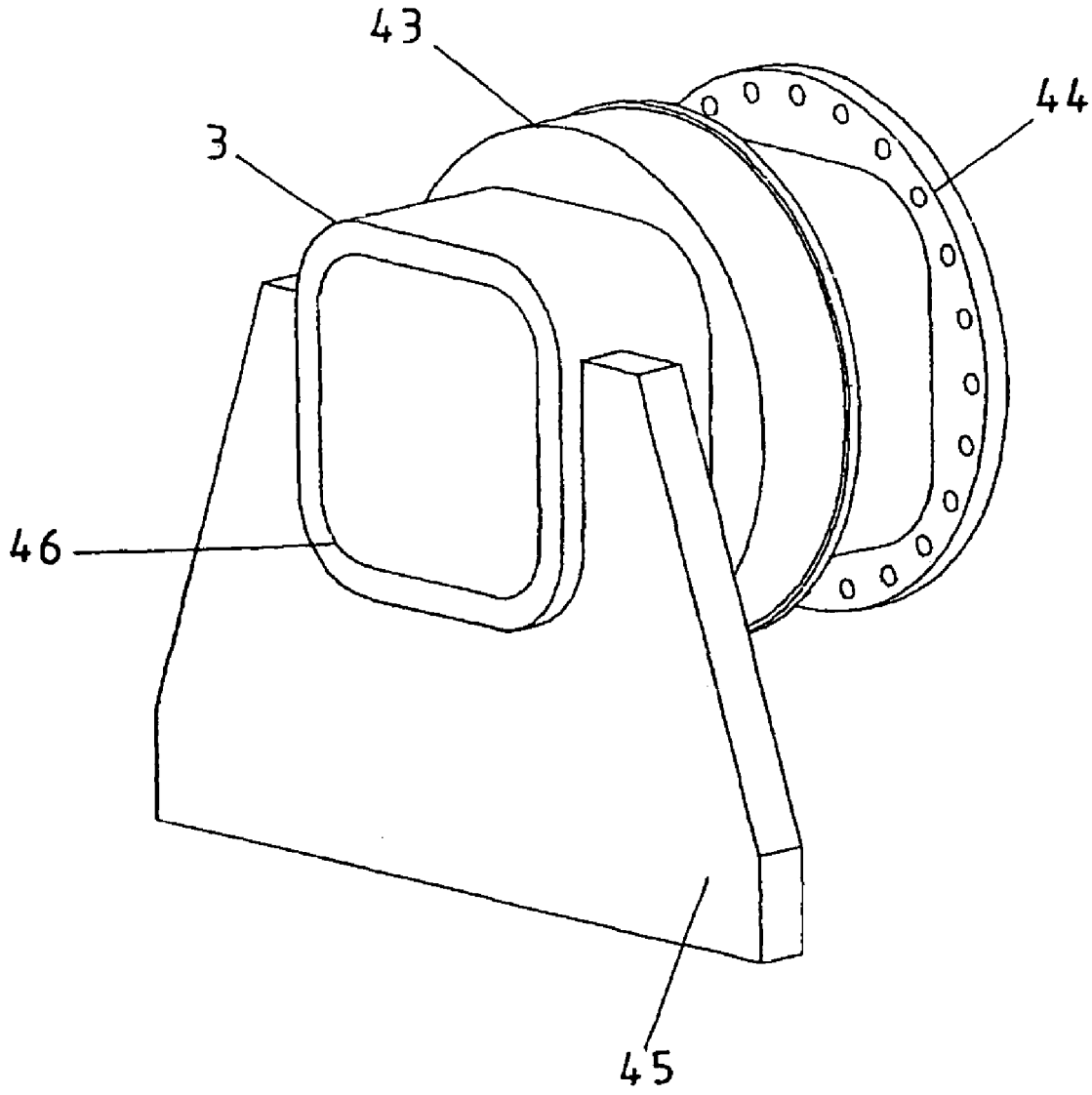

FIG. 5 shows the section of a hollow shaft positioned on a bearing pedestal 45, said shaft being formed here as a polygon, namely as a rectangle with rounded off corners 46. With this, a separate anti-twist protection is not required. Furthermore, the connections for ventilation devices are substantially simpler in this case. The bearing ring is designated as 43, and the connecting flange to the stator frame is designated as 44.

All features listed above, including those to be taken from the drawings individually, are regarded as being essential to the invention both on a stand-alone basis as well as in combination.

The invention claimed is:

1. Leading sheave winder or a drum winder comprising an electric motor (5) for driving winding ropes (11), wherein a rotor (6) of said motor is connected to a cylinder jacket (4) of the leading sheave winder (2) or drum and its stator frame (7) is secured on a support structure that has a hollow shaft (3), the motor (5) being located within the cylinder jacket (4) and between plates (13) of the leading sheave winder (2) or drum in a cavity (12), where said cavity can be supplied with cooling air to ventilate the motor (5) from an exterior, characterized in that the hollow shaft (3) is formed by at least two half shafts (18, 19), which form a support structure (10) with at least one support disc and the stator frame (7).

2. Leading sheave winder or drum winder according to claim 1, further comprising a ventilation zone (1), which is supplied with cooling air through the hollow shaft (3) and enclosed by the stator frame (7) as well as the at least one lateral support disc (8, 9) connecting together the hollow shaft (3) and the stator frame (7).

3. Leading sheave winder or drum winder according to claim 2, characterised in that between the at least one support disc (8, 9) is a partition wall (16) that divides the ventilation zone (1) into a supply line (1') and a discharge line (1").

4. Leading sheave winder or drum winder according to claim 3, characterised in that the at least one support disc (8) is formed as a partition wall (16) as well.

5. Leading sheave winder or drum winder according to claim 2, characterised in that reinforcing metal sheets (22) extending in radial direction to the hollow shaft (3) are in the ventilation zone (1).

6. Leading sheave winder or drum winder according to claim 5, characterised in that the reinforcing metal sheets (22) are formed as air baffle plates.

7. Leading sheave winder or drum winder according to claim 2, characterised in that the hollow shaft (3) has boreholes (23, 24) for the air supply and the air discharge, which boreholes correspond with the ventilation zone (1).

8. Leading sheave winder or drum winder according to claim 7, characterised in that the boreholes (23, 24) are in a central shaft section (42).

9. Leading sheave winder or drum winder according to claim 7, characterised in that the boreholes (23) for the air supply and the boreholes (24) for the air discharge are separated from one another by an additional partition wall (16) or an extension of a partition wall (16).

10. Leading sheave winder or drum winder according to claim 1, characterised in that the at least one support disc (8, 9) is arranged at least approximately vertical to the hollow shaft (3).

11. Leading sheave winder or drum winder according to claim 1, characterised in that the at least two half shafts (18, 19) are connected to the at least one support disc (8) at their inner ends (20, 21) by means of flanges (14, 15).

12. Leading sheave winder or drum winder according to claim 11, characterised in that radial-aligned cooling air ducts (33) are integrated in the flanges (14, 15) of the half shafts (18, 19).

13. Leading sheave winder or drum winder according to claim 1, characterised in that the at least one support disc (8, 9) has openings (17) to, as seen with reference to the hollow shaft (3), an axial cooling air outlet or inlet.

14. Leading sheave winder or drum winder according to claim 1, characterised in that the at least two half shafts (18, 19) are each detachably connected, at their inner ends (20, 21), to a side disc (8, 9).

15. Leading sheave winder or drum winder according to claim 1, characterised in that between the at least two half shafts (18, 19) is a middle structural component (27), which is formed from a central shaft section (42) and the at least one support disc (8, 9).

16. Leading sheave winder or drum winder according to claim 1, characterised in that bearing seats (25, 26) are allocated to the hollow shaft (3) for connecting the hollow shaft (3) with the cylinder jacket (4).

17. Leading sheave winder or drum winder according to claim 1, characterised in that the hollow shaft (3) has a polygonal cross-section.

* * * * *